US005944615A

United States Patent [19]

Lee

[11] Patent Number: 5,944,615

[45] Date of Patent: Aug. 31, 1999

[54] GOLF PRACTICE APPARATUS

[76] Inventor: Bum Ho Lee, 1245-5, Kuweol 2-Dong, Namdong-Ku, Incheon, Rep. of Korea

[21] Appl. No.: 09/186,783

[22] Filed: Nov. 4, 1998

[30] Foreign Application Priority Data

Aug. 11, 1998 [KR] Rep. of Korea ..... 98-15078

[51] Int. Cl.[6] ..... A63B 69/36

[52] U.S. Cl. ..... 473/279

[58] Field of Search ..... 473/279, 278

[56] References Cited

U.S. PATENT DOCUMENTS

| | | | |
|---|---|---|---|
| 5,333,876 | 8/1994 | Goto | 273/195 B |
| 5,431,406 | 7/1995 | Ishi | 473/279 X |
| 5,470,074 | 11/1995 | Hotchkiss et al. | 273/195 B |
| 5,683,306 | 11/1997 | Tait et al. | 473/279 |
| 5,820,478 | 10/1998 | Wood et al. | 473/279 |

*Primary Examiner*—George J. Marlo
*Attorney, Agent, or Firm*—Robert D. Fish; Crockett & Fish

[57] ABSTRACT

A golf practice apparatus comprises a plurality of slope control cylinders which are hinged on corresponding cylinder supports adjacent to a central portion of a base frame with one end of each of the slope control cylinders and are swivelly connected on a lower surface of each corner of the platform with another end of each of the slope control cylinders, and a swiveller provided at the other end of the slope control cylinder; the swiveller comprising a bracket mounted on the lower surface of the platform, a barrel type drum rotatably assembled with a bracket by a through pin, and an eye end formed at the other end of the slope control cylinders and as a bearing encompassing said barrel surface of the drum.

4 Claims, 14 Drawing Sheets

GOLF PRACTICE APPARATUS

BACKGROUND OF THE INVENTION

1. Field of the Invention

This invention relates to a golf practice apparatus having a slopable platform, more particularly to a golf practice apparatus having a slopable platform with which variable sloping of the platform can be attained like that of an actual outdoor golf course.

2. Prior Art

Generally, a golf shot is classified into wood or Tee-shot, iron-shot, and putting. Tee-shot is a long distance shot, in which a golfer hits a ball put on a tee pushed into mild flat ground. Iron-shot is a middle distance shot, in which golfer hits the ball settled on the ground toward a green. Putting occurs when that golfer hits the ball on the green to a hole.

There are various hazards, e.g., a pond, woods, and a steep hill, to hamper the shot of the golfer. In most cases, golfer wants to practice at the steepest slope resulting a disadvantageous standing position. To satisfy the needs of a golfer, a golf practice apparatus which exhibits various slope angles to a ground is introduced, which can be installed both outdoors and indoors.

The typical conventional golf practice apparatus is shown in FIGS. 1, 2, and 3. The golf practice apparatus comprises a platform 10, a central tilting member 15 provided under a central portion of a lower surface of the platform 10, and a pair of driving members (FIG. 3) provided in a base member 20 in longitude and traverse for applying a driving force to the platform 10, thereby enabling the platform 10 to be tilted in a predetermined angle around the central tilting member 15.

A ball receiving member 25 is assembled on the lower central portion of the platform 10 for allowing a pivot of a ball of the central tilting member 15. The central tilting member 15 has a ball 15B being pivotedly engaged in the ball receiving member 25, and a shaft 15S extended downwardly from the ball 15B. A lower portion of the shaft 15S is fixed to a central tilting member supporter 16. As shown in FIG. 3, a pair of driving members comprise a pair of screws 30*a*,30*b* which are arranged on the base member 20 with crossing at the central tilting member 15, two pair of drum type moving members 35*a*, 35*b*, 35*c*, 35*d* which are threaded with corresponding screw 30*a*, 30*b*, respectively, and can reciprocatedly move along the screw 30*a*, 30*b* during the rotation of the screws 30*a*, 30*b*. The rotation of each screw 30*a*, 30*b* can be attained by mesh engagement between a driving gear 45*a*, 45*b* provided at a motor 40*a*, 40*b* and a driven gear 50*a*, 50*b* provided at one end of each of the screws 50*a*, 50*b*. One end of each of the links 55*a*, 55*b*, 55*c*, 55*d* is hingedly assembled with each of the moving members 35*a*, 35*b*, 35*c*, 35*d*, and another end of each of links 55*a*, 55*b*, 55*c*, 55*d* is ball-joined to the lower surface of the platform 10.

Hereafter, the operation of the conventional golf practice apparatus will be described as below.

Firstly, power is applied to the motor 40*a*, 40*b*, to enable the driving gear 45*a*, 45*b* to be rotated clockwise or counterclockwise. Thus, the driving force of each driving gear 45*a*, 45*b* is transferred to each driven gear 50*a*, 50*b* meshed with corresponding driving gear 45*a*, 45*b*. The screw 30*a*, 30*b* is rotated clockwise or counterclockwise by the corresponding rotation of the driven gear 50*a*, 50*b*, thus enabling the moving member 35*a*, 35*b*, 35*c*, 35*d* to be reciprocated along the screw 30*a*, 30*b*. Both ends of each of the links 55*a*, 55*b*, 55*c*, 55*d* are moved as the center at each connecting portion at which each upper end of each of the links 55*a*, 55*b*, 55*c*, 55*d* is assembled with the platform 10, while each lower end thereof is assembled with the moving member 35*a*, 35*b*, 35*c*, 35*d*. Each link 55*a*, 55*b*, 55*c*, 55*d* is placed parallel or perpendicular to the ground. The movement of the links 55*a*, 55*b*, 55*c*, 55*d* causes a corresponding corner of the platform 10 to move up or down, thereby enabling the platform 10 to be sloped in various angles.

Therefore, the golfer stands on the platform 10 which is sloped according to golfer's need for practicing a shot.

However, in the conventional golf practice apparatus which exhibits various slopes of the platform by the link, if a length of the link is short, the slope angle of the platform is lessened, and a disadvantage occurs since a steep slope can hardly be attained.

Further, in the conventional golf practice apparatus which has a weak supporting structure, each link 55*a*, 55*b*, 55*c*, 55*d* primarily receives weight of both the platform 10 and golfer, and thus there is a high possibility of an accident because the link can not bear a very high load of the golfer.

THE SUMMARY OF THE INVENTION

It is an object of the present invention to solve these problems. The object of this invention is to provide golf practice apparatus capable of exhibiting various slopes of a platform, thus a golfer can practice his shot under conditions like a real outdoor golf course.

To obtain the object, a golf practice apparatus is provided which is comprised of a platform on which a golfer hits a golf ball, a base frame provided under the platform, a plurality of cylinder supporters provided on the base frame, a central cylinder provided at a central portion of the base frame, and supporting a central portion of the platform, thereby to tilt the platform, a plurality of slope control cylinders which are hinged on corresponding cylinder supports adjacent to the central portion of the base frame with one end of each of the slope control cylinders and are swivelly connected on a lower surface of each corner of the platform with another end of each of the slope control cylinders, and each of the slope control cylinders making independent operation, thereby to move up and down each corner of the platform, a swiveller provided at the other end of the slope control cylinder, the swiveller comprising a bracket mounted on the lower surface of the platform, a barrel type drum rotatably assembled with the bracket by a through pin, and an eye end formed at the other end of the slope control cylinders and as a bearing encompassing the barrel surface of the drum, and a controller for controlling the operation of each of the cylinders to enable a slope of the platform to variably change.

Further, the golf practice apparatus additionally comprises a foot switch for sending a slope control signal to the controller, the foot switch is mounted on the platform.

Further, the golf practice apparatus additionally comprises a safety valve unit to control pressure of working fluid of each of the slope control cylinders, the pressure of working fluid properly responds to a load applied to each portion of the platform.

Preferably, the platform comprises a frame, a support plate placed on the frame, a rubber mat provided on some area of the support plate for a golfer to stably stand on the rubber mat, and an artificial turf provided on an other area of the support plate, on which a golf ball is placed, an upper surface level of the turf is maintained unevenly.

BRIEF DESCRIPTION OF THE DRAWINGS

This invention will be better understood and its various objects and advantages will be more fully appreciated from the following description taken in conjunction with the accompanying drawings, in which.

DETAILED DESCRIPTION OF THE PREFERRED EMBODIMENT

Hereinafter, this invention will be described in detail with reference to the drawings.

Figure 1:
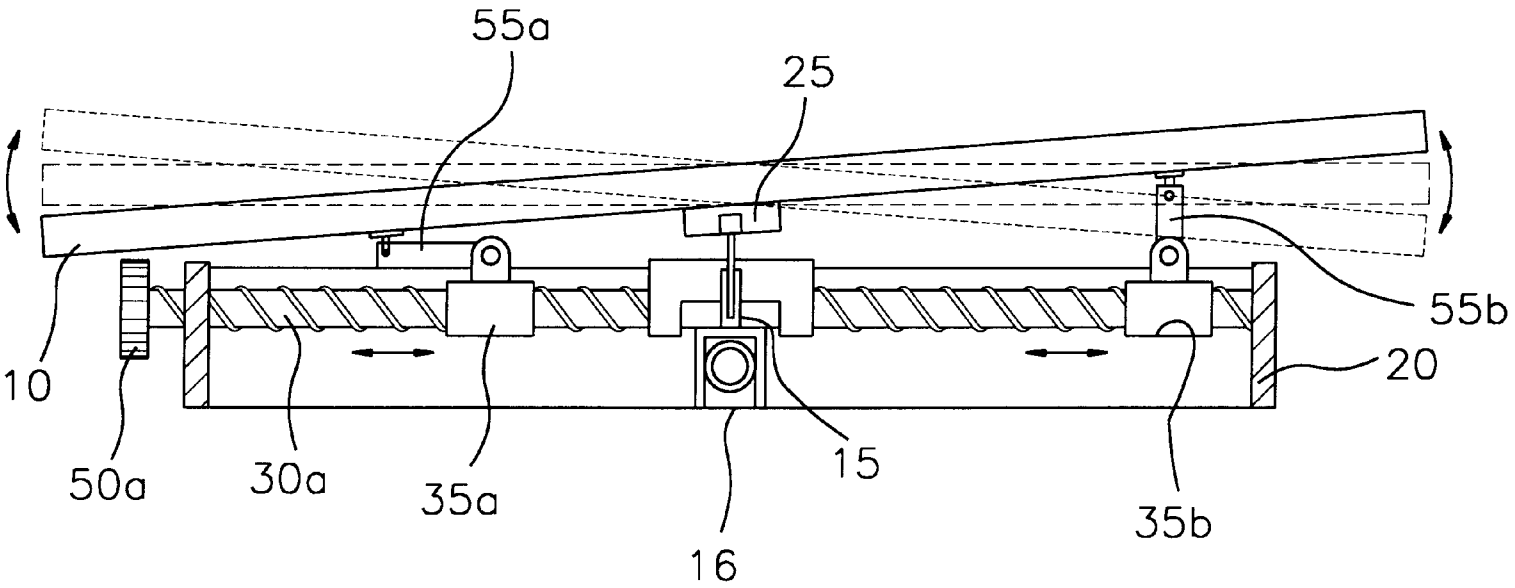
FIG. 1 PRIOR ART
FIG. 1 is a side view of a golf practice apparatus according to a prior art.
Figure 2:
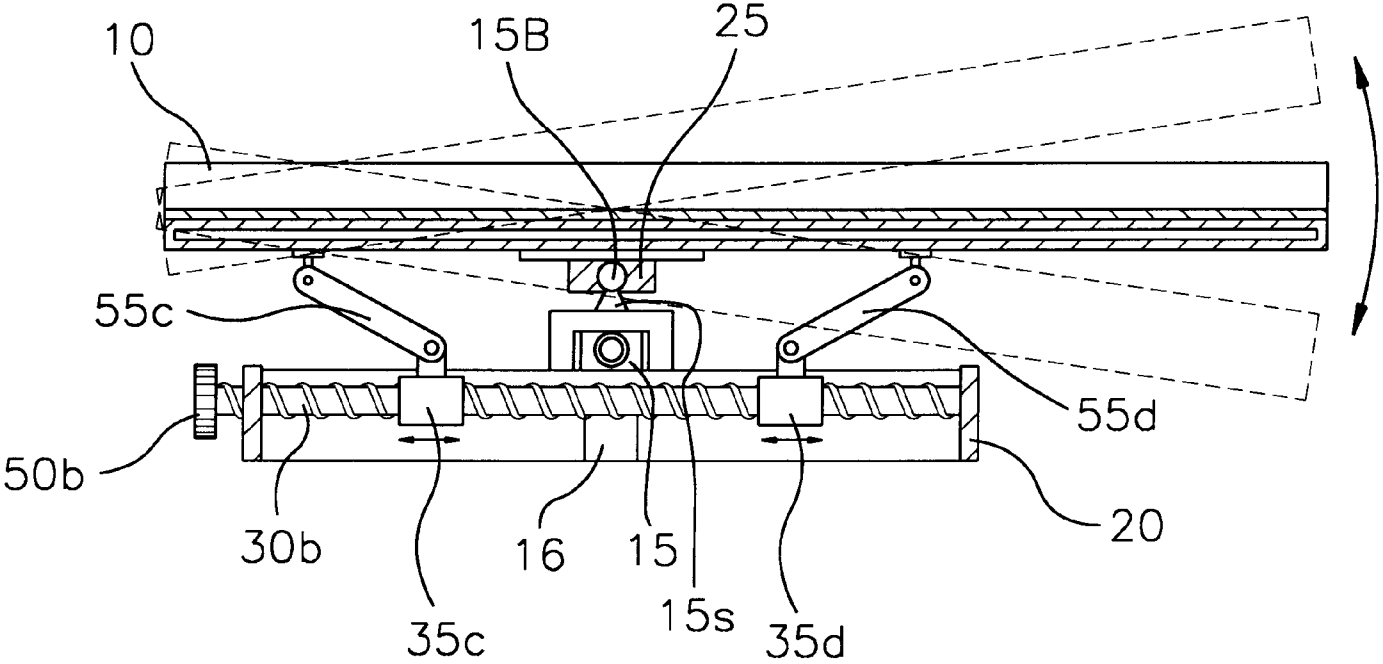
FIG.2 PRIOR ART
FIG. 2 is a cross-sectional view of FIG. 1.
Figure 3:
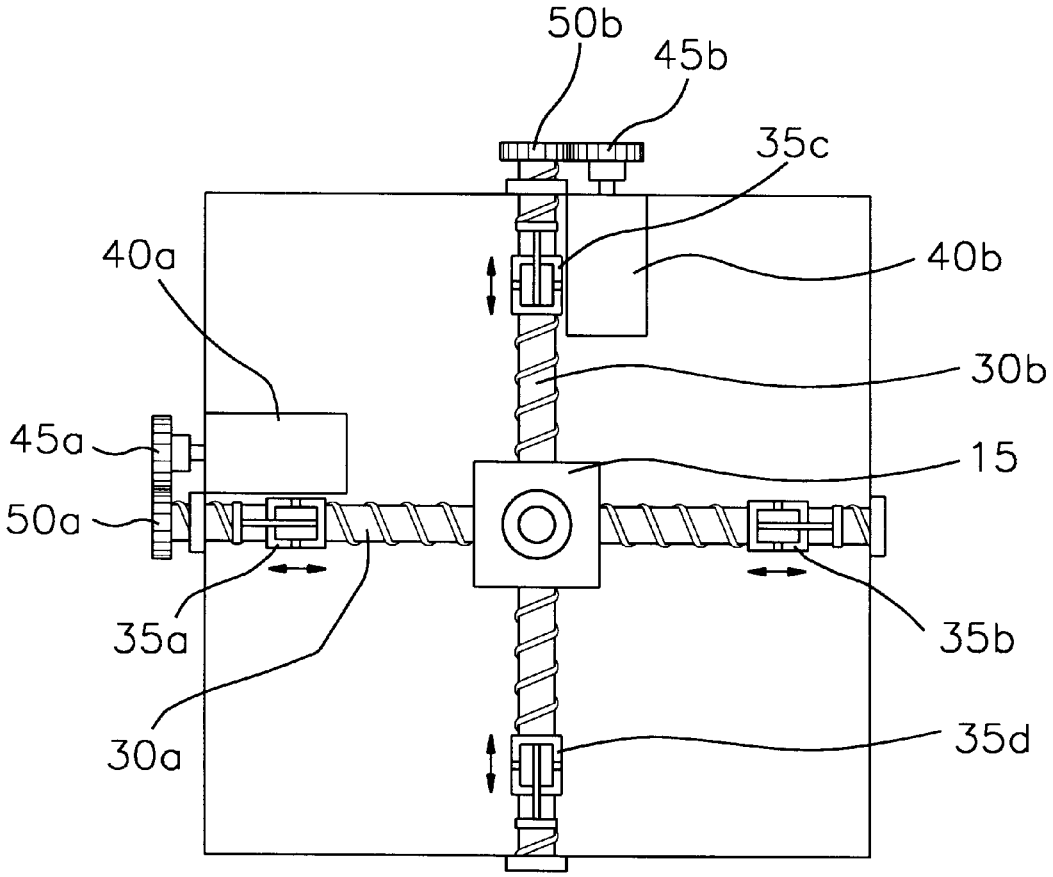
FIG.3 PRIOR ART
FIG. 3 is a plan view of FIG. 1 except for a platform.
Figure 4:
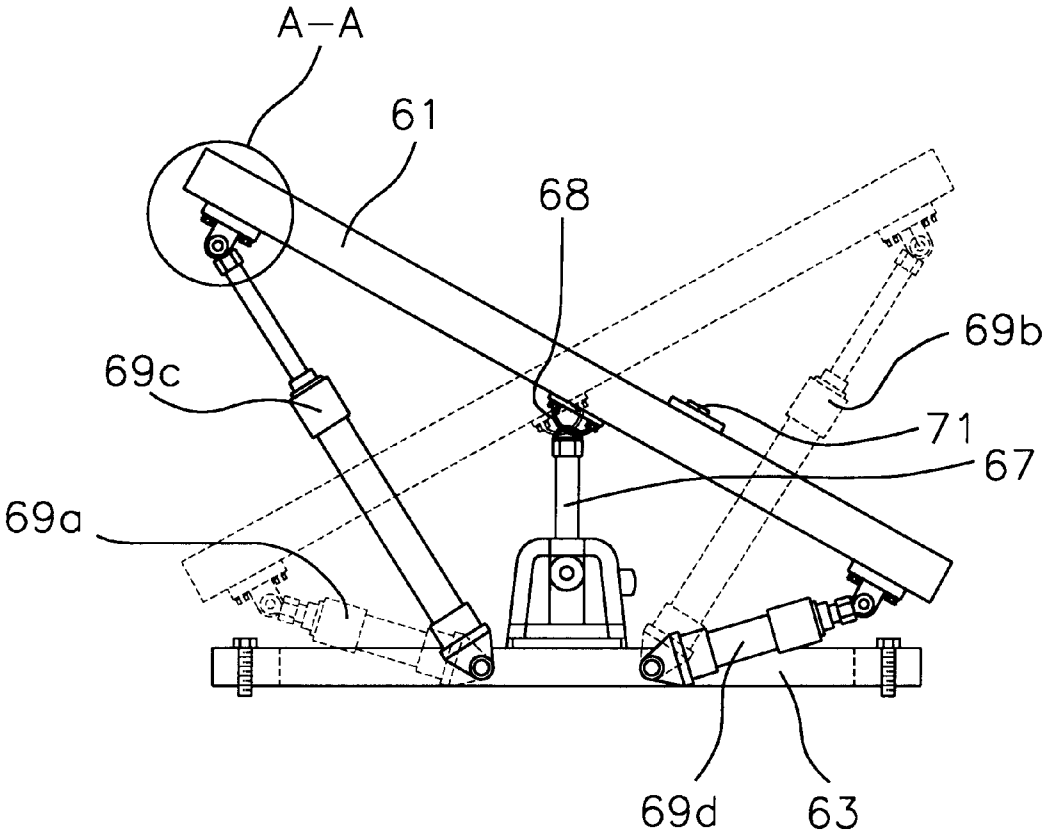
FIG. 4 is side view of a golf practice apparatus according to a first preferred embodiment of the present invention.

FIG. 4 is a side view of a golf practice apparatus according to the present invention. The golf practice apparatus comprises a platform 61 on which a golfer hits a golf ball, a base frame 63 provided under the platform 61, a plurality of cylinder supporters 65 provided on the base frame 63, a central cylinder 67 provided at a central portion of the base frame 63, and supporting a central portion of the platform 61, thereby enabling the platform 61 to move like a universal joint, four slope control cylinders 69*a*, 69*b*, 69*c*, 69*d* which are arranged at the circumference of the central cylinder 67 and independently operate and move up/down each corner of the platform 61, and a controller (not shown) for controlling the operation of each of the cylinders to enable a slope of the platform 61 to variably change.

Figure 9:
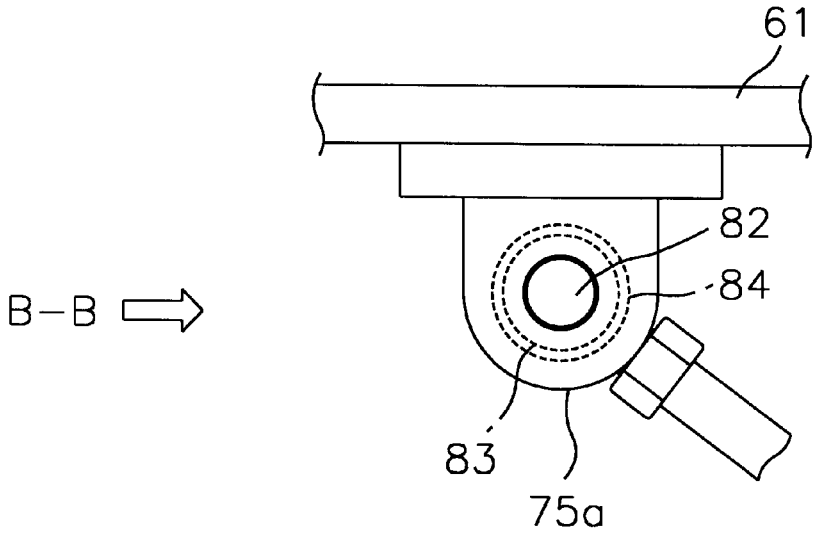
FIG. 9 is an enlarged side view of AA portion of FIG. 4.
Figure 10:
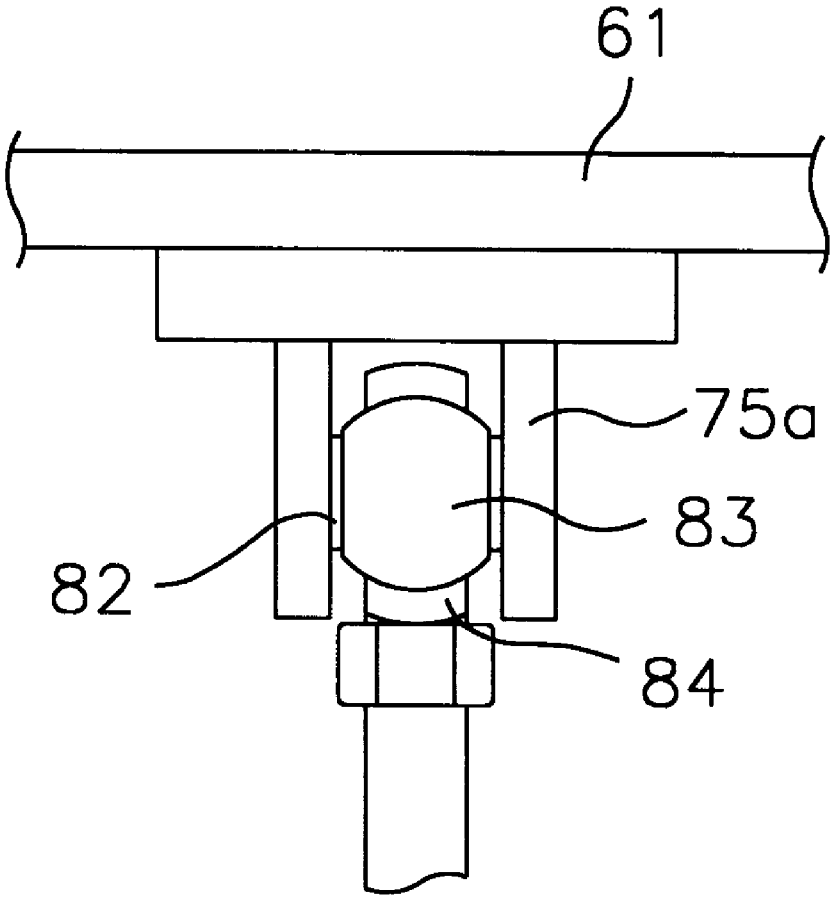
FIG. 10 is an enlarged front view of a swiveller in a non sloped position shown along arrow BB of FIG. 9.

The golf practice apparatus , as shown in FIGS. 9 and 10, further comprises a swiveller 80 provided at each upper end of the slope control cylinders 69*a*, 69*b*, 69*c*, 69*d* to enable the slope of the platform to variably change.

Figure 8:
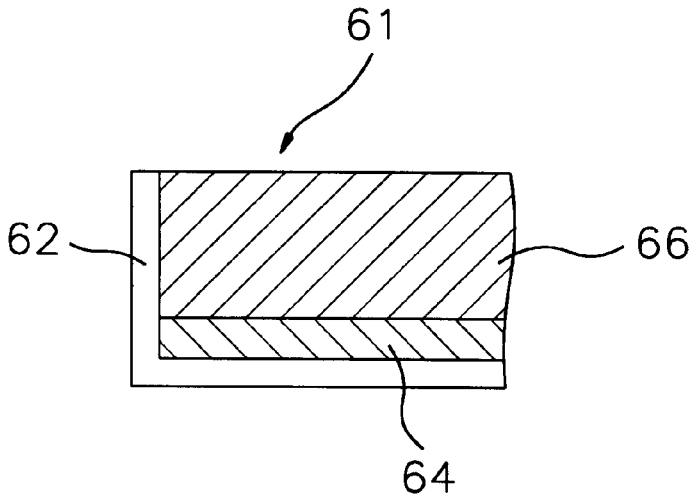
FIG. 8 is an enlarged cross-sectional view of one corner of platform of FIG. 4.
Figure 8A:
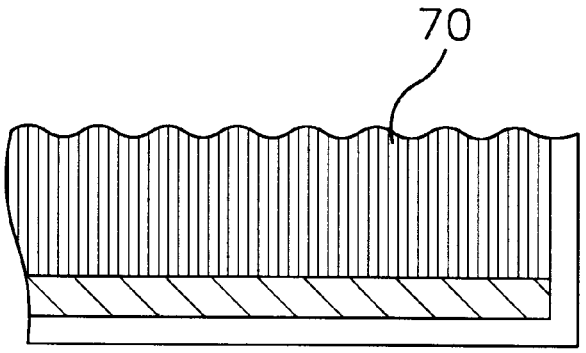
FIG. 8A is an enlarged cross-sectional view of an other corner of platform of FIG. 4.

The platform 61, as shown in FIG. 8, comprises a platform frame 62, a support plate 64 placed on the platform frame 62, and a rubber mat 66 provided on some area of the support plate 64 for a golfer to stably stand on the rubber mat 66. Further, the platform 61 , as shown in FIG. 8A, comprises an artificial turf 70 provided on an other area of the support plate 64. An upper surface level of the turf 70 is maintained unevenly to simulate an outdoor condition. A foot switch 71 is mounted on the platform 61 to send a slope control signal to the controller. The platform 61 slopes while a golfer presses the foot switch 71.

Figure 6:
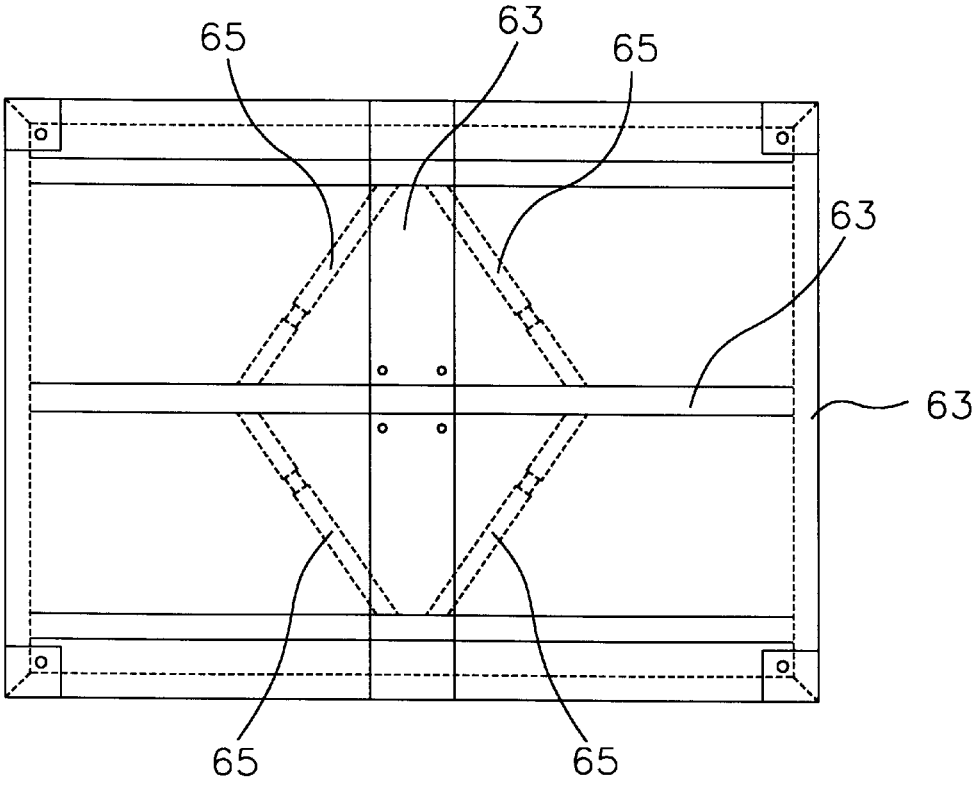
FIG. 6 is a plan view of FIG. 5 except for cylinders.
Figure 7:
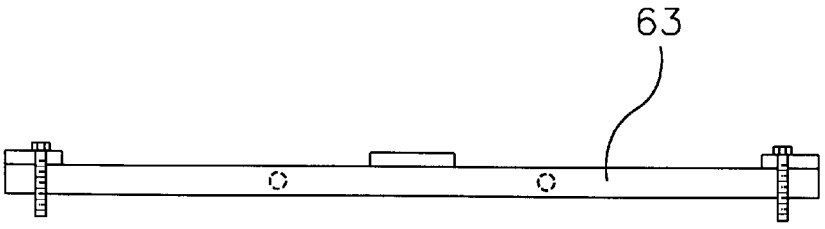
FIG. 7 is a side view of FIG. 6.

The base frame 63, as shown in FIGS. 6 and 7, comprises a rectangular shaped outer frame, and an inner frame which criss-crosses in the outer frame. The cylinder supporter 65 is placed on the inner frame in a diamond shape as shown in FIG. 6.

Figure 5:
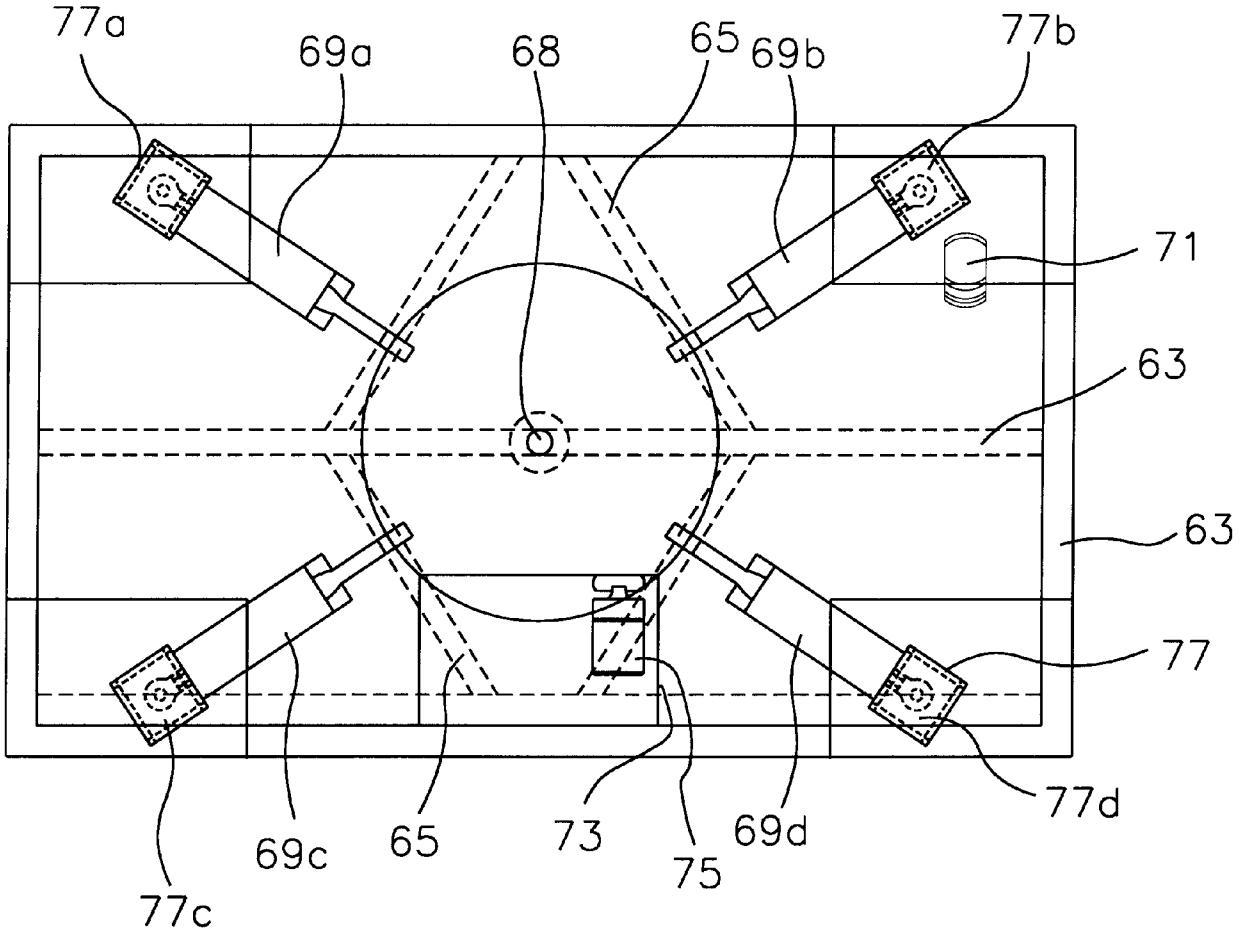
FIG. 5 is a plan view of FIG. 4 except for a platform.

Each slope control cylinder 69*a*, 69*b*, 69*c*, 69*d*, as shown in FIGS. 4 and 5, is hinged with a lower end of each of the slope control cylinders 69*a*, 69*b*, 69*c*, 69*d* on corresponding cylinder supporters 65 which are arranged adjacent to the central cylinder 67. Further, each slope control cylinder 69*a*, 69*b*, 69*c*, 69*d* is swivelly connected with upper end of each of the slope control cylinders 69*a*, 69*b*, 69*c*, 69*d* on a lower surface of each corner of the platform 61.

A swiveller 80 is provided at the upper end of each of the slope control cylinders 69*a*, 69*b*, 69*c*, 69*d*. The swiveller 80 comprises a bracket 77*a*, 77*b*,77*c*,77*d* mounted on the lower surface of the platform 61, a barrel type drum 83 rotatably assembled with the bracket 77*a*, 77*b*,77*c*,77*d* by a through pin 82, and an eye end 84 formed at the upper end of the slope control cylinders 69*a*, 69*b*, 69*c*, 69*d* and as a bearing encompassing the barrel surface of the drum 83 as shown in FIGS. 9 and 10.

During the independent straight extension and retract movement of each slope control cylinder, each corner of the platform 61 is independently sloped according to each different swivelling angle between the eye end 84 and the barrel type drum 83.

A joint member, e.g., universal-joint 68, is formed at an upper end of the central cylinder 67. The joint member 68 is hingedly connected on the lower surface of the platform 61. Thus, the platform 61 can be sloped without any restriction. The slope control cylinders 69*a*, 69*b*, 69*c*, 69*d* and the central cylinder 67 are made by a hydraulic cylinder. Each cylinder is extended and retracted by which a solenoid valve 75 controls pressure of hydraulic fluid fed from a fluid tank 73 mounted on the base flame 63.

The golf practice apparatus further comprises a safety valve unit (not shown) for controlling pressure of working fluid of each of the slope control cylinders 69*a*, 69*b*, 69*c*, 69*d*. The controlled pressure of working fluid properly responds to a load applied to each portion of the platform 61. Preferably, a relay, a timer optical fiber sensor, a power switch, a position holding switch, and a reset switch are additionally assembled to the golf practice apparatus, thereby achieving reliable operation of the platform and stable maintenance of the slopes position of the platform by one touch method of a golfer.

For commercial use of the golf practice apparatus, a coin receiving unit (not shown) could be optionally connected, thus enabling operation of the platform to be actuated during the golfer's paid allotted time.

Hereafter, the operation of the inventive golf practice apparatus will be illustrated.

A golfer stands on the platform 61 to practice a shot and presses the foot switch 71 to send a slope control signal to the controller. Next, the controller controls the operation of the solenoid valve 75, and the pressure of the fluid through the solenoid valve 75 is applied to each cylinder 67, 69*a*, 69*b*, 69*c*, 69*d*.

Figure 11:
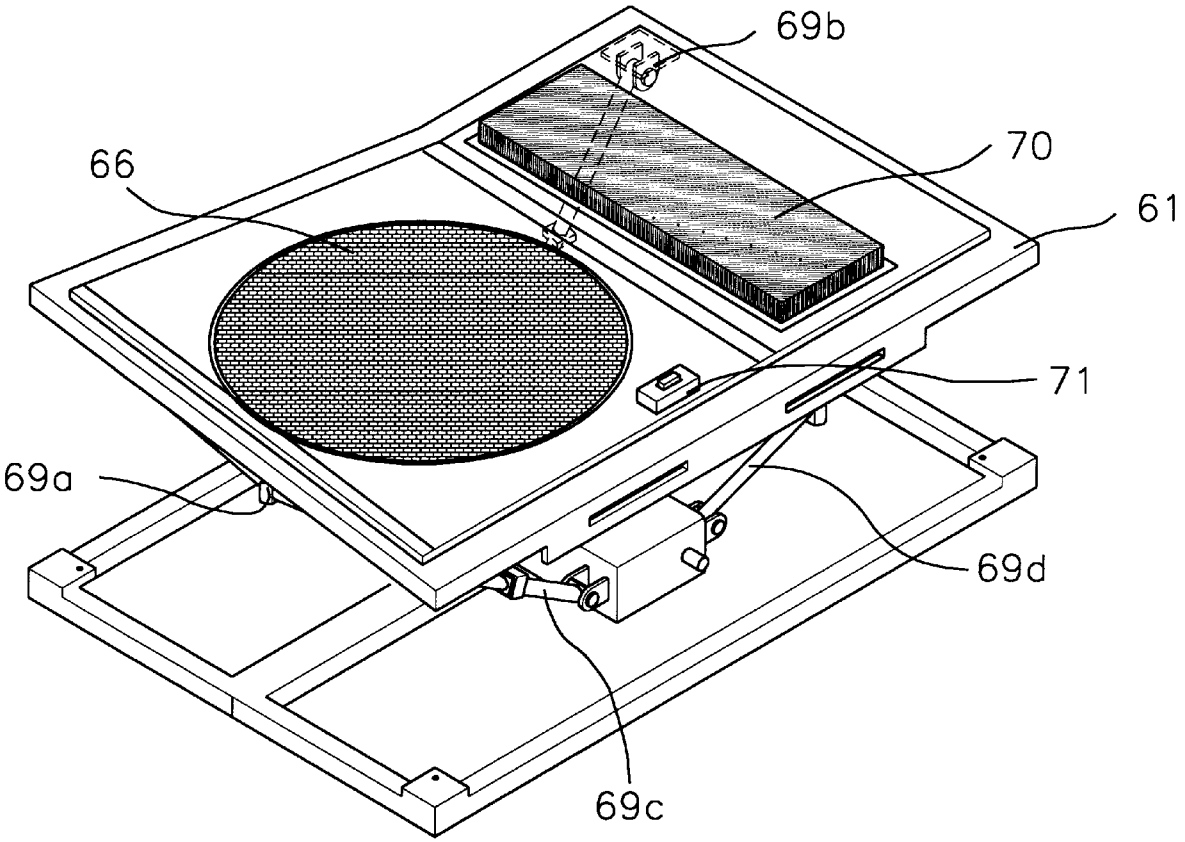
FIG. 11 is a perspective view of a sloped golf practice apparatus of FIG. 4.
Figure 12:
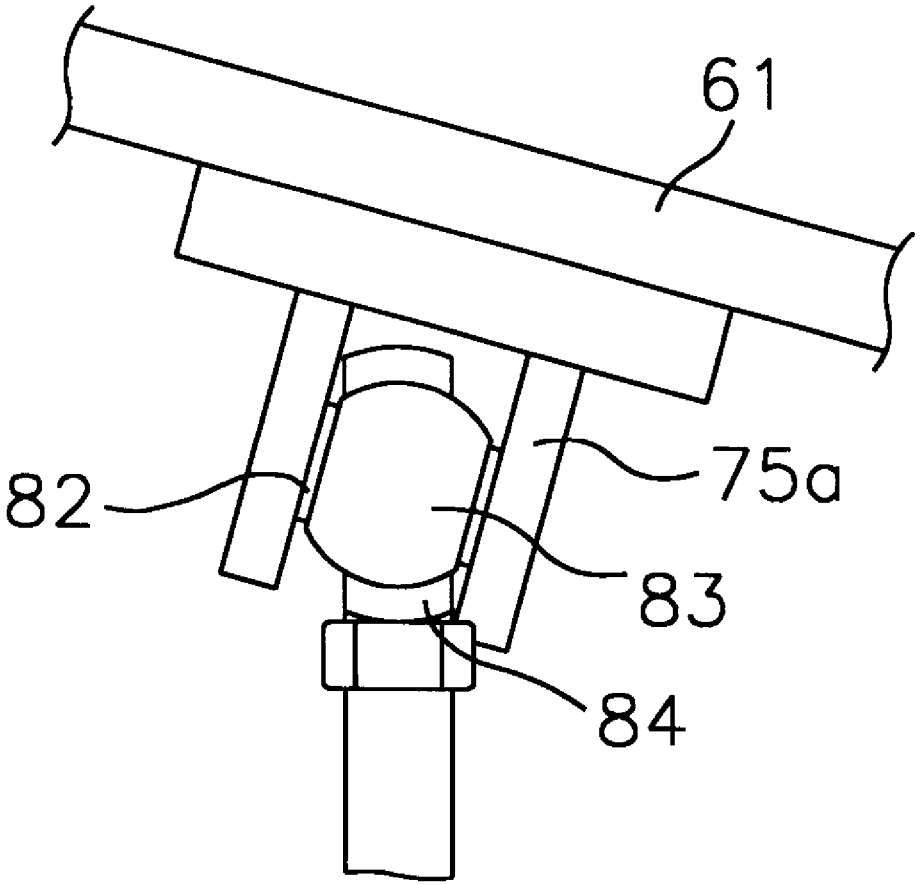
FIG. 12 is an enlarged front view of the swiveller in a sloped position shown along arrow BB of FIG. 9.

The central cylinder 67 is extended in a predetermined length by the hydraulic pressure of the fluid, thus establishing the proper height of the platform 61, of which an upper surface is maintained in a horizontal level to the ground. Simultaneously, four slope control cylinders 69*a*, 69*b*, 69*c*, 69*d* are extended in each different length, thus sloping each corner of the platform 61 at a different angle. For instance, as shown in FIG. 11, the slope control cylinder 69*c* is extended in a predetermined longer length while the slope control cylinder 69*d* is extended less than the extended length of the slope control cylinder 69*c*. Therefore, the platform 61 is inclined toward the upper end of the slope control cylinder 69*d* owing to the swivel movement of the barrel type drum 83 of the swiveller 80 as shown in FIG. 12.

That is, the drum 83 of the swiveller 80 which is provided at the more extended cylinder 69*c* swivels less than the drum 83 of the swiveller 80 which is provided at the less extended cylinder 69*d*. When the platform 61 is sloped, the corner of the platform 61 adjacent to the upper end of the slope control cylinder 69*d* receives the heaviest load. Thus, the safety valve unit increases the fluid pressure of the slope control cylinder 69*d* to respond to the overload applied to the slope control cylinder 69*d*.

If the extended length of the slope control cylinder 69*d* is zero, that is, the level of the corner of the platform 61 is at the minimal level, a position between the drum 83 and the eye end 84 is explained as shown in FIG. 10. In this condition, the slope control cylinder 69*c* is in the middle extended length, the barrel type drum 83 of the slope control cylinder 69*c* swivels on the eye end 84 of the slope control cylinder 69*c*, and of which a position is illustrated in FIG. 12.

Next, if the cylinder extension relationship between the more extended slope control cylinder 69*c* and the less extended slope control cylinder 69*d* is transferred to the relationship between the slope control cylinder 69*d* and the nearby slope control cylinder 69*b*, the slope condition of the platform 61 illustrated as above can be revived by the slope control cylinder 69*d* and the nearby slope control cylinder 69*b*.

If the slope control cylinder 69*d* in the lowest height is extended to the middle height, a position between the drum 83 and the eye end 84 of the slope control cylinder 69*d* which was shown in FIG. 10 is changed to a position shown in FIG. 12.

Simultaneously, the slope control cylinder 69*c* in the middle height is extended to the highest height, i.e., a position between the drum 83 and the eye end 84 of the slope control cylinder 69*c* which was shown in FIG. 12 is changed to a position shown in FIG. 10.

At the same time, the slope control cylinder 69*b* in the middle height is retracted to the lowest height, i.e., a position between the drum 83 and the eye end 84 of the slope control cylinder 69*b* which was shown in FIG. 12 is changed to a position shown in FIG. 10.

While each slope control cylinder is extended or retracted in the above sequence, the sloping of the platform 62 is unlimited or an all-round angle with independent swivelling motion of each of the swivellers occurs.

While the shifting of the slope of the platform 61, a golfer moves his foot away from the foot switch 71 to stop the movement of the platform 61. Thus, a golfer can hit a ball in the intended slope of the platform.

Figure 13:
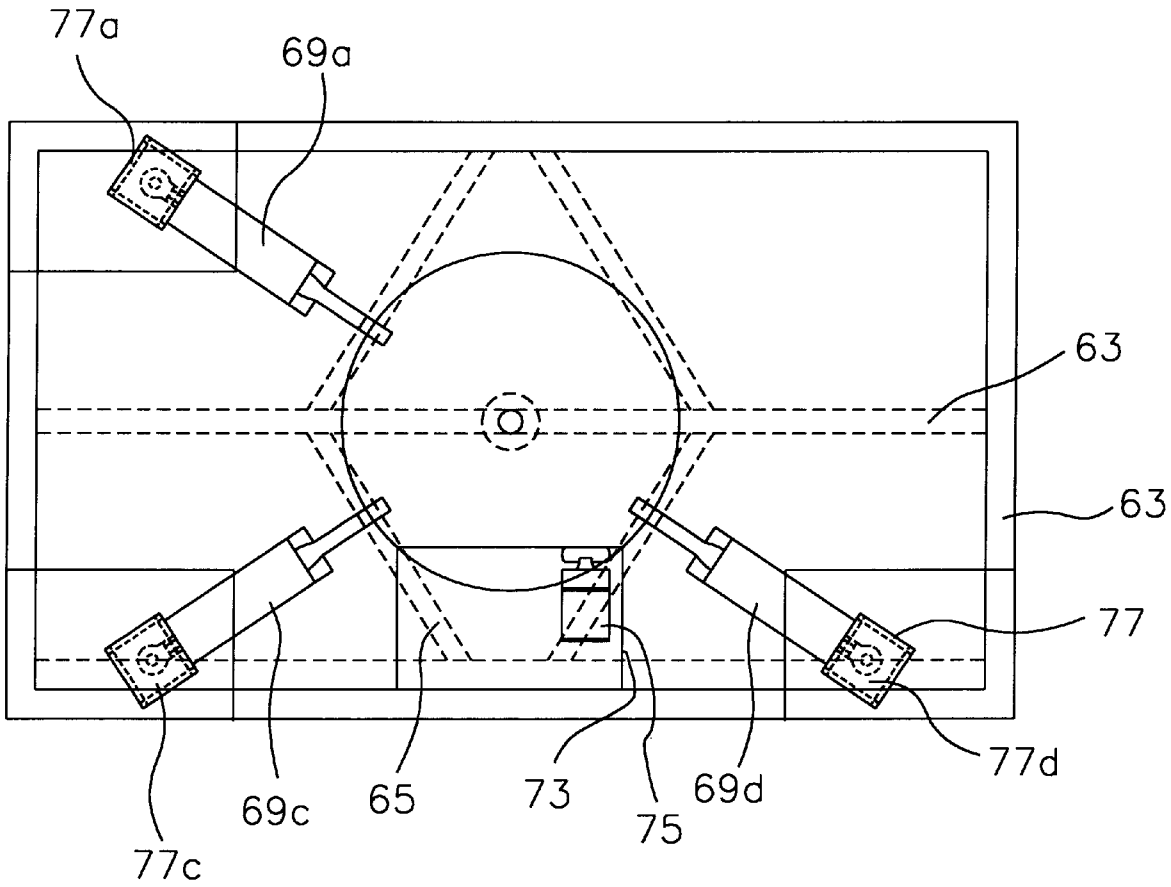
FIG. 13 is a plan view of a second embodiment of a golf practice apparatus.
Figure 14:
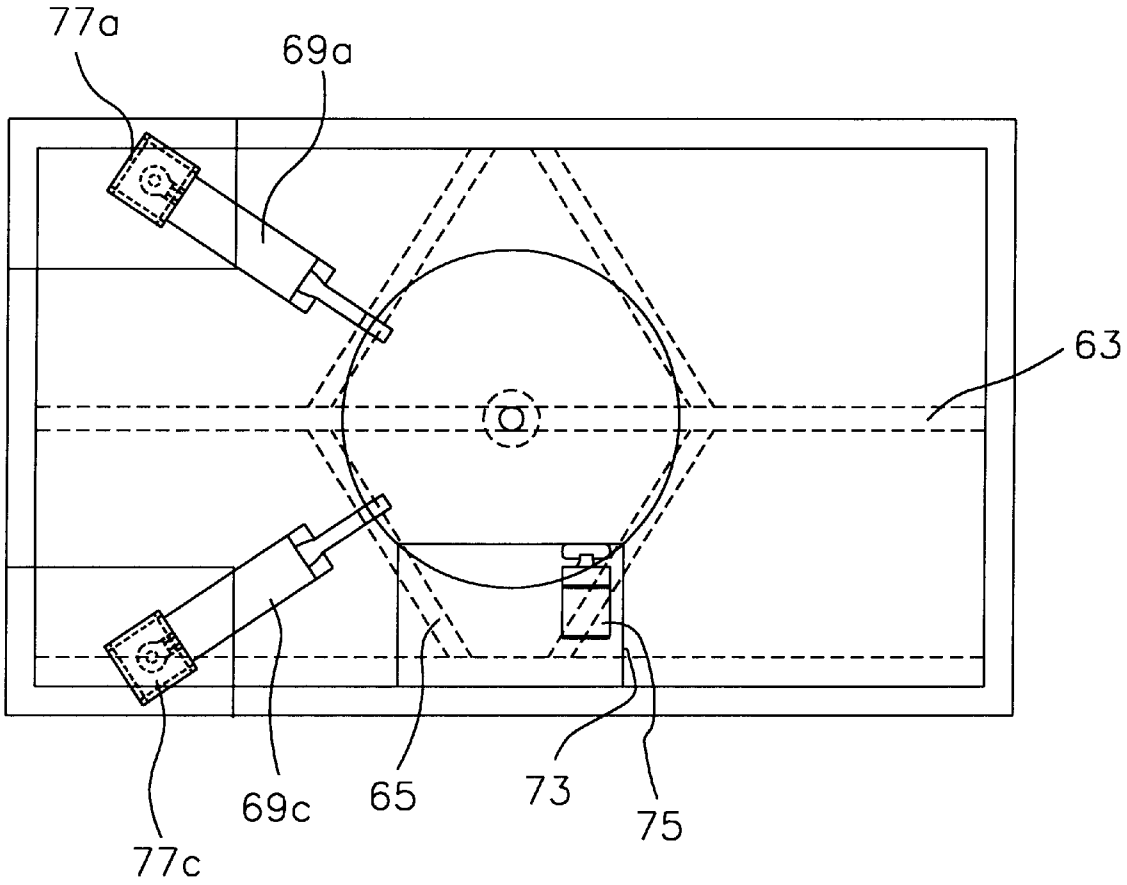
FIG. 14 is a plan view of a third embodiment of a golf practice apparatus.
Figure 15:
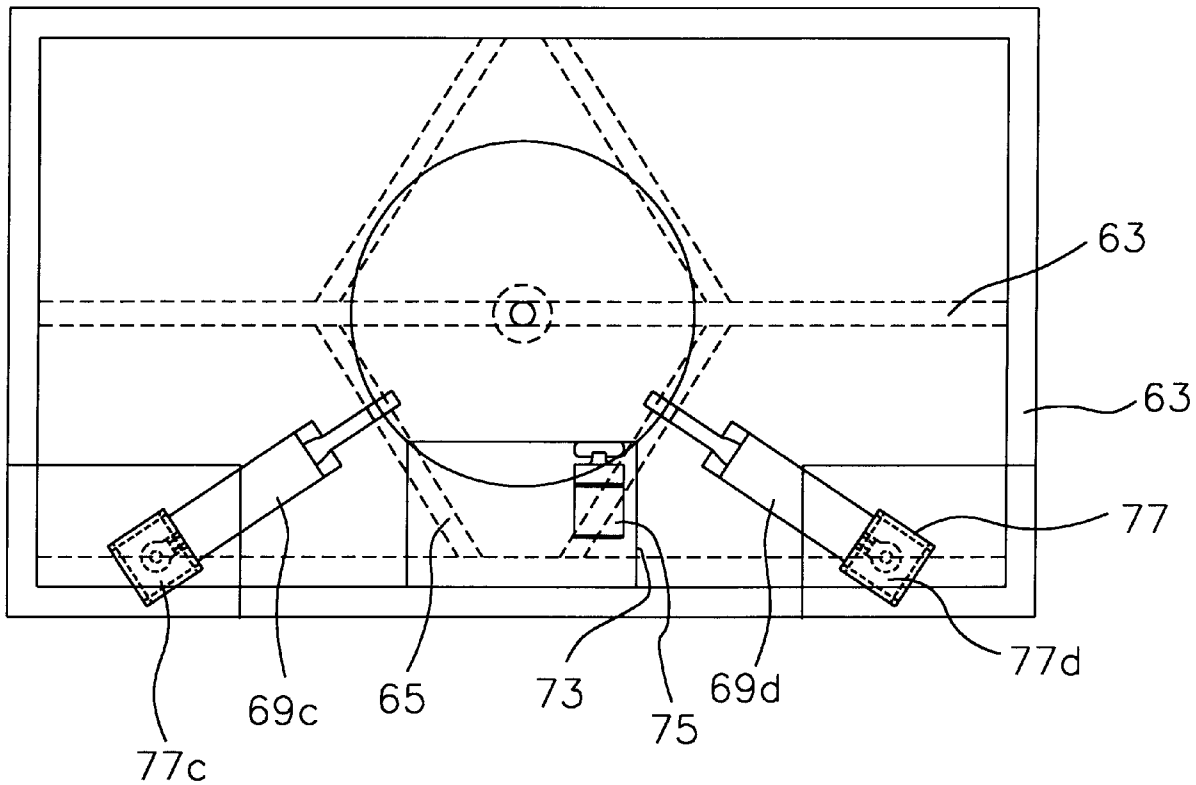
FIG. 15 is a plan view of a fourth embodiment of a golf practice apparatus.

Although the number of the slope control cylinders is four in the above embodiment, the slope control cylinders can be arranged in FIGS. 13, 14 and 15 depending upon the convenient usage of the golf practice apparatus.

While this invention has been particularly shown and described with reference to particular embodiments thereof, it will be understood by those skilled in the art that various changes in form and details may be effected therein without departing from the spirit and scope of the invention as defined by the appended claims.

What is claimed is:

1. Golf practice apparatus comprising:

a platform on which a golfer hits a golf ball;

a base frame provided under said platform;

a plurality of cylinder supports provided on said base frame;

a central cylinder provided at a central portion of said base frame, and supporting a central portion of said platform, thereby to tilt said platform;

a plurality of slope control cylinders which are hinged on corresponding cylinder supports adjacent to said central portion of said base frame with one end of each of the slope control cylinders and are swivelly connected on a lower surface of each corner of said platform with another end of each of said slope control cylinders, and each of said slope control cylinders making independent operation, thereby to move up and down each corner of said platform;

a swiveller provided at the other end of said slope control cylinder, said swiveller comprising a bracket mounted on said lower surface of said platform, a barrel type drum rotatably assembled with said bracket by a through pin, and an eye end formed at the other end of said slope control cylinders and as a bearing encompassing said barrel surface of said drum; and a controller for controlling the operation of each of said cylinders to enable a slope of said platform to variably change.

2. The golf practice apparatus according to claim 1, wherein said golf practice apparatus further comprises a foot switch for sending a slope control signal to said controller, said foot switch is mounted on said platform.

3. The golf practice apparatus according to claim 1, wherein said golf practice apparatus further comprises a safety valve unit to control pressure of working fluid of each of said slope control cylinders, the pressure of working fluid properly responds to a load applied to each portion of said platform.

4. The golf practice apparatus according to claim 1, wherein said platform comprises a frame, a support plate placed on said frame, a rubber mat provided on some area of said support plate for a golfer to stably stand on said rubber mat, and an artificial turf provided on other area of said support plate, on which a golf ball is placed, an upper surface level of said turf is maintained unevenly.

* * * * *